US010584505B2

(12) United States Patent
D'Joos

(10) Patent No.: US 10,584,505 B2
(45) Date of Patent: Mar. 10, 2020

(54) ROLLING SUPPORT FOR BLEACHERS

(71) Applicant: SEDA Seating Ltd., Burlington (CA)

(72) Inventor: Jimmy D'Joos, Lommel (BE)

(73) Assignees: Jimmy D'Joos, Lommel (BE); Ladislav Kelemen, Burlington, Ontario (CA)

( * ) Notice: Subject to any disclaimer, the term of this patent is extended or adjusted under 35 U.S.C. 154(b) by 0 days.

(21) Appl. No.: 16/167,888

(22) Filed: Oct. 23, 2018

(65) Prior Publication Data

US 2019/0119936 A1 Apr. 25, 2019

Related U.S. Application Data

(60) Provisional application No. 62/575,864, filed on Oct. 23, 2017, provisional application No. 62/588,762, filed on Nov. 20, 2017.

(51) Int. Cl.
*E04H 3/12* (2006.01)

(52) U.S. Cl.
CPC ..... *E04H 3/123* (2013.01); *E04H 3/126* (2013.01)

(58) Field of Classification Search
CPC ..... E04H 3/123; E04H 3/126
USPC ..... 52/7–10
See application file for complete search history.

(56) References Cited

U.S. PATENT DOCUMENTS 2,683,292 A * 7/1954 Slonaker ..... A63J 1/00 52/9
3,178,154 A * 4/1965 McClelland ..... D06B 3/10 254/1
5,682,711 A * 11/1997 Warczak ..... E04H 3/14 52/6

FOREIGN PATENT DOCUMENTS

EP 337592 A1 * 10/1989
JP 03100278 A * 4/1991
WO WO-9425706 A1 * 11/1994 ..... A47C 1/126
WO WO-2006076774 A1 * 7/2006 ..... E04H 3/123

* cited by examiner

*Primary Examiner* — Adriana Figueroa
(74) *Attorney, Agent, or Firm* — Head, Johnson, Kachigian & Wilkinson, PC

(57) ABSTRACT

A rolling support for bleachers apparatus. The apparatus includes a frame, a plurality of wheel arrangements, each wheel arrangement including a strut to which a wheel is rotatably mounted, the strut pivotally mounted to the frame for movement between a retracted position and an extended position. The wheel arrangement also includes a spring biasing the strut for movement towards the extended position, a trigger arm pivotable between a locked position and an unlocked position and a spring biasing the trigger arm for movement towards the locking position.

3 Claims, 5 Drawing Sheets

ROLLING SUPPORT FOR BLEACHERS

CROSS-REFERENCE TO RELATED APPLICATION

This application claims the benefit of U.S. Provisional Patent Application Ser. No. 62/575,864 filed Oct. 23, 2017 and U.S. Provisional Patent Application Ser. No. 62/588,762 filed Nov. 20, 2017.

BACKGROUND OF THE INVENTION

1. Field of the Invention

The invention relates to the field of arena/stadium seating.

2. Prior Art

In structures that have a smooth flat floor, it is known to provide a seating apparatus of the type having a plurality of rows of seats movable between a storage configuration, wherein the rows are disposed on top of one another, and a seating configuration, wherein the rows are spread apart relative to one another to form a bleacher.

However, in mixed use facilities, it is known for the floor to have: a generally horizontal, planar, base surface; and a generally horizontal, planar raised floor surface, elevated in relation to the base surface such that a step is formed between the base surface and the raised surface.

SUMMARY OF THE INVENTION

Forming one aspect of the invention is apparatus for use with a facility of the type having: a generally horizontal, planar, base surface; and a generally horizontal, planar raised floor surface, elevated in relation to the base surface such that a step is formed between the base surface and the raised surface.

The apparatus comprises a frame and a plurality of wheel arrangements.

Each wheel arrangement includes a strut, a strut spring, a trigger arm and a trigger spring.

The strut has a wheel rotatably mounted thereto and is pivotally mounted to the frame for movement between a retracted position and an extended position.

At the retracted position of the strut, when the wheel is operatively positioned upon the raised surface for rolling movement of the apparatus the uppermost limit of the frame terminates at an elevation.

At the extended position of the strut when the wheel is operatively positioned upon the base surface for rolling movement of the apparatus the uppermost limit of the frame terminates at the elevation.

The spring biases the strut for movement towards the extended position.

The trigger arm is pivotable between a locked position and an unlocked position.

At the locked position of the trigger arm and when the strut is in the extended position and the wheel is operatively positioned upon the base surface, the trigger arm locks the strut against movement away from the extended position and the trigger arm projects to an elevation below that of the raised surface.

At the unlocked position of the trigger arm and when the strut is in the retracted position and the wheel is operatively positioned upon the raised surface: the trigger arm locks the strut against movement beyond the retracted position, the strut locks the trigger arm against movement beyond the unlocked position; and the arm projects to the elevation of the raised surface.

The trigger spring biases the trigger arm for movement towards the locking position.

The wheel arrangement is adapted such that:

- when the wheel is operatively disposed upon the base surface, the strut is in the extended position and the trigger arm is in the locked position, as the apparatus is rolled from the base surface to the raised surface, the trigger arm hits the step and pivots away from the locked position to unlock the strut for movement towards the retracted position;
- as the trigger arm bridges the step during movement of the apparatus from the base surface to the raised surface, it urges the strut from the extended position to the retracted position; and
- as the apparatus is driven from the raised surface to the base surface, the springs urge the trigger arm and the strut to the locked and extended positions.

Advantages, features and characteristics of the present invention will become apparent upon review of the following detailed description and the appended drawings, the latter being briefly described hereinafter.

DETAILED DESCRIPTION OF THE PREFERRED EMBODIMENTS

Figure 1:
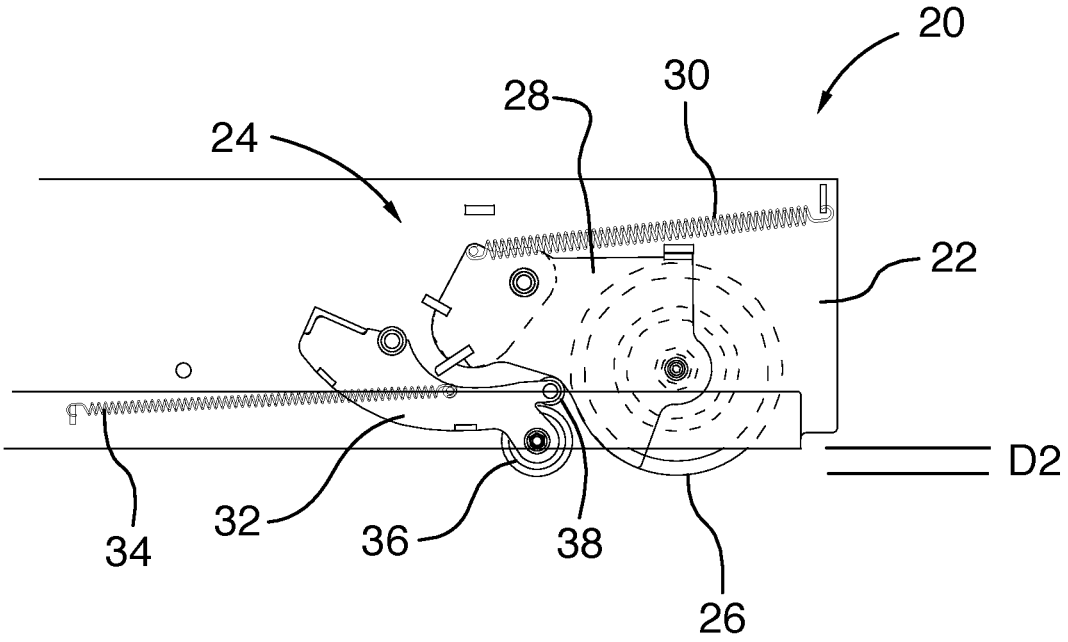
FIG. 1 is a side view of apparatus according to an exemplary embodiment of the invention, with the strut in the retracted position and the trigger arm in the unlocking position.
Figure 2:
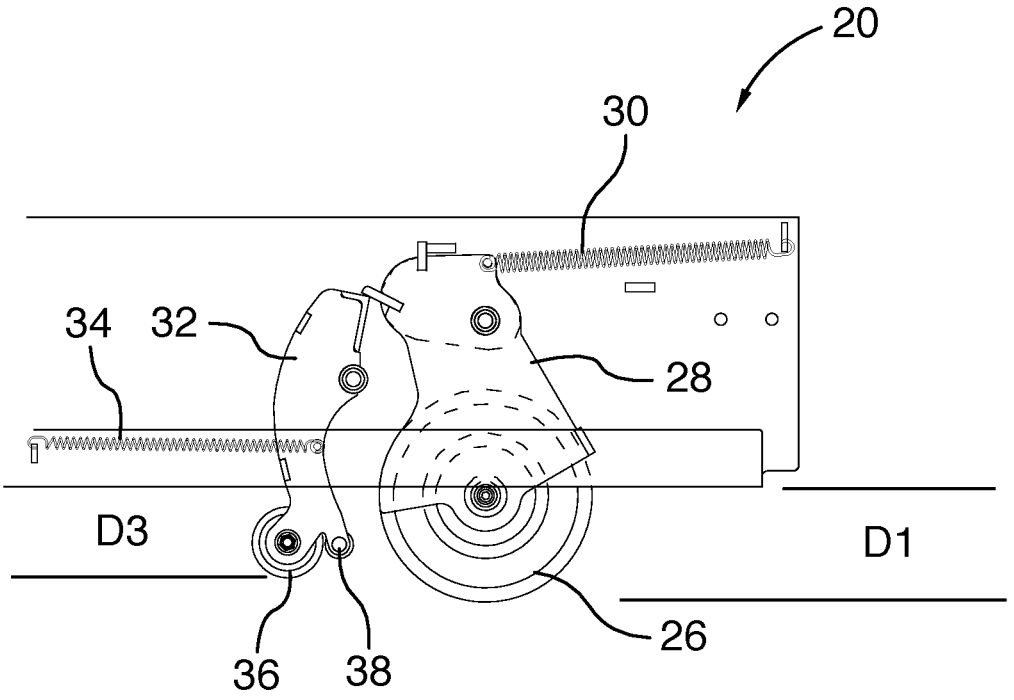
FIG. 2 is a view of the structure of FIG. 1 with the strut in the extended position and the trigger arm in the locked position.

Apparatus 20 according to an exemplary embodiment of the invention is shown in FIG. 1 and FIG. 2 and will be seen to comprise a frame 22 and a plurality of wheel arrangements 24.

Each wheel arrangement 24 includes a strut 28, a strut spring 30, a trigger arm 32 and a trigger spring 34.

The strut 28 has a wheel 26 rotatably mounted thereto and is pivotally mounted to the frame 22 for movement between a retracted position shown in FIG. 1 and an extended position shown in FIG. 2. In the extended position of the strut 28, the wheel 26 projects a distance D1 from the frame 22; in the retracted position of the strut 28, the wheel 26 projects a distance D2 from the frame 22.

The strut spring 30 biases the strut 28 for movement towards the extended position.

The trigger arm 32 is mounted to the frame 22 for pivotal movement between a locked position shown in FIG. 2 and an unlocked position shown in FIG. 1 and includes a terminal wheel 36 and a roller 38, both rotatably attached thereto.

In the unlocked position [FIG. 1], trigger arm 32 projects distance D2 from the frame 22.

In the locked position of the trigger arm 32 shown in FIG. 2, it will be seen that:

when the strut 28 is in the extended position [also as shown in FIG. 2] the trigger arm 32 locks the strut 28 against movement towards the retracted position; and the trigger arm 32 projects from the frame 22 a distance D3 that is intermediate D1 and D2; and when the strut 28 is in the retracted position [as shown in FIG. 1], the trigger arm 32 locks the strut 28 against movement beyond the retracted position and the strut 28 locks the trigger arm 32 against movement beyond the unlocked position.

The trigger spring 34 biases the trigger arm 32 for movement towards the locking position.

Figure 3:
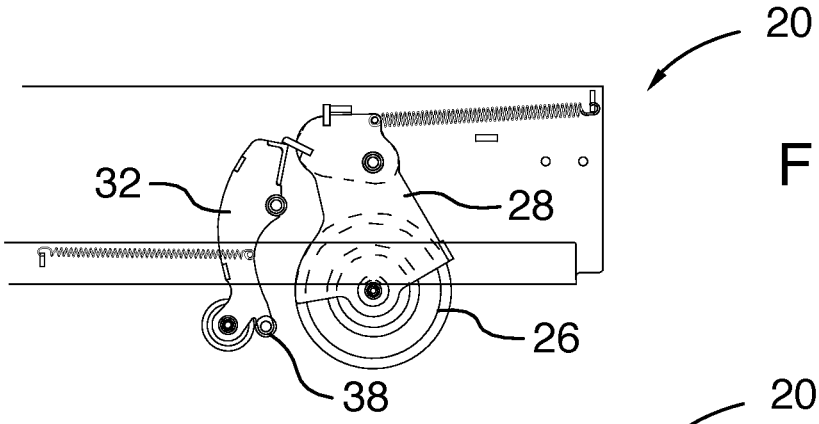
FIG. 3 is a view similar to FIG. 2.
Figure 4:
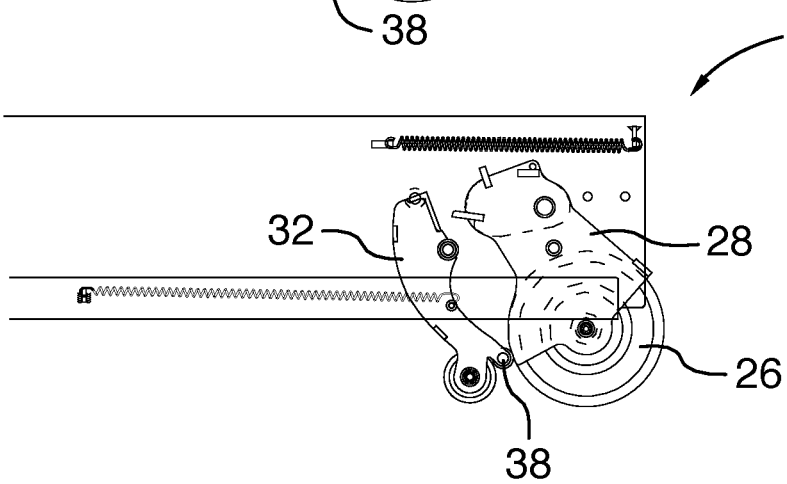
FIG. 4 is a view similar to FIG. 3 with the trigger arm moved away from the locking position and the strut moved away from the extended position.
Figure 5:
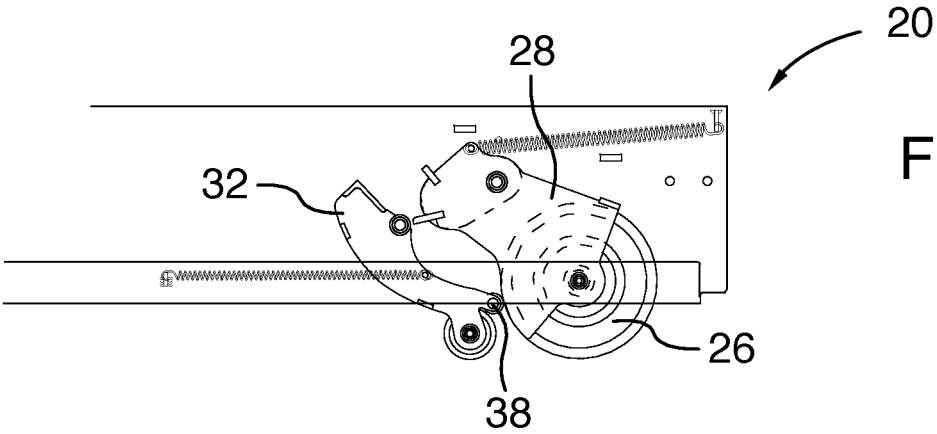
FIG. 5 is a view similar to FIG. 4 with the trigger arm moved further away from the locking position and the strut moved further away from the extended position.
Figure 6:
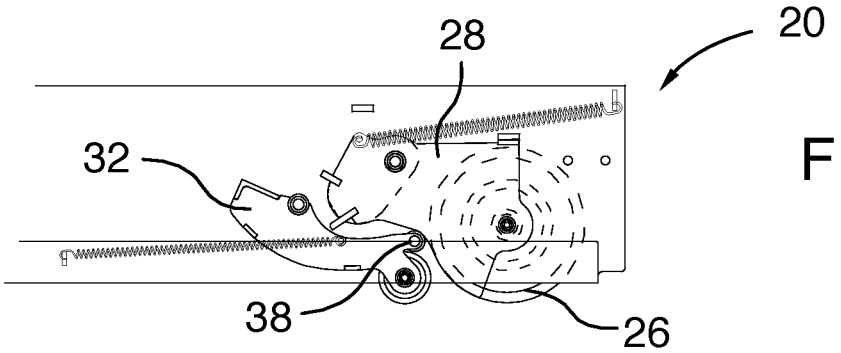
FIG. 6 is a view similar to FIG. 1.

The sequence of FIGS. 3-6 show the apparatus transitioning from the configuration shown in FIG. 2 to the configuration shown in FIG. 1 in FIG. 3, the strut 28 is in the extended position and the wheel 26 is fully extended and locked;

in FIG. 4 the trigger arm 32 has pivoted away from the locking position, allowing the strut 28 to start to pivot by force placed thereupon by roller 38;

in FIG. 5, the roller 38 has traversed further up the strut 28 and the strut 28 has pivoted further towards the retracted position;

finally, in FIG. 6, the strut 28 has moved to the fully retracted position and the trigger arm 32 has moved to the unlocked position; no further movement is possible, as the strut 28 blocks movement of the trigger arm 32 and vice-versa.

Figure 7:
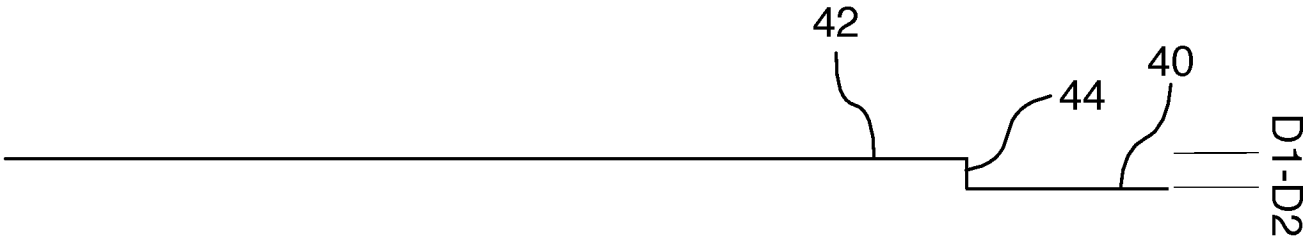
FIG.7 (PRIOR ART)
FIG. 7 is a view of a prior art surface.

The apparatus 20 is advantageously used with a facility as shown in FIG. 7, namely, a facility having a generally horizontal, planar, base surface 40; and a generally horizontal, planar raised floor surface 42, elevated in relation to the base surface 40 such that a step 44 is formed between the base surface 40 and raised surface 42, the step 44 having a height equal to D1-D2.

FIGS. 8-13 show a manner in which the apparatus 20 can be used.

Figure 8:
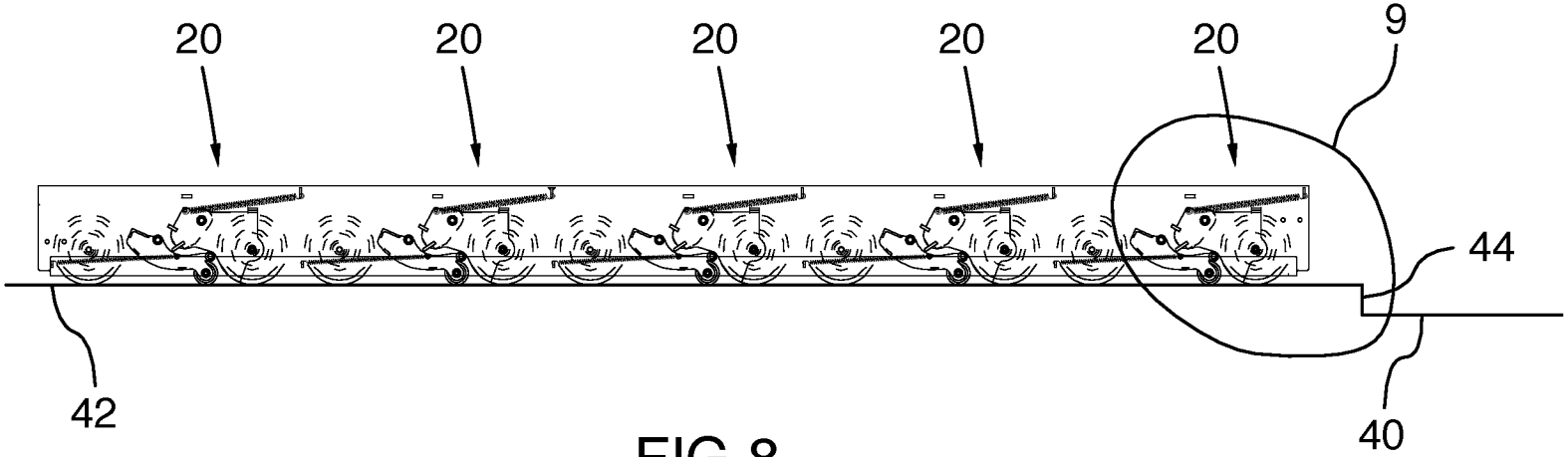
FIG. 8 is a view of a plurality of the structures of FIG. 1 in use with the structure of FIG. 7.

More particularly:

FIG. 8 shows a plurality of the apparatus 20 disposed upon the raised surface 42 of the facility.

Figure 9A:
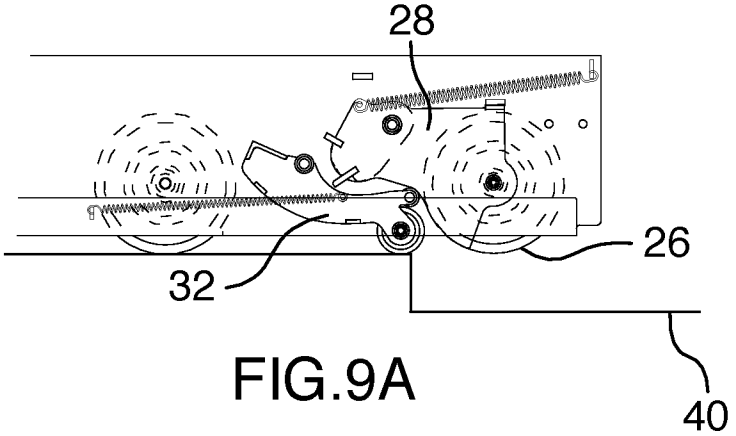
FIG. 9A is a view of encircled structure 9 of FIG. 8 as it would appear if the structures of FIG. 8 were shifted to the right.

FIG. 9A is an enlarged view of the structure of encircled area 9 of FIG. 8 as it appears when the plurality of apparatus 20 have been rolled towards and in overhanging relation to the base surface 40; as shown in FIG. 9A, the wheel 26 is disposed in space relation to the base surface 40, since strut 28 still is locked against rotation by trigger arm 32.

Figure 9B:
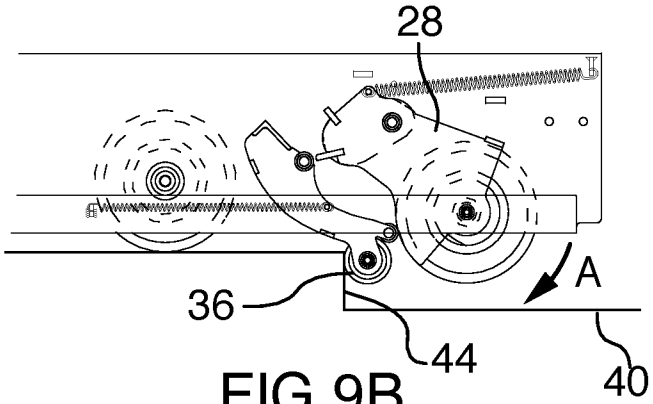
FIG. 9B is a view similar to FIG. 9A with the structure shifted to the right.

FIG. 9B shows the structure of FIG. 9A shifted further to the right; in this position, terminal wheel 36 has started to roll down step 44, thereby allowing strut 28 to start pivoting away from the retracted position, as indicated by arrow A.

Figure 9C:
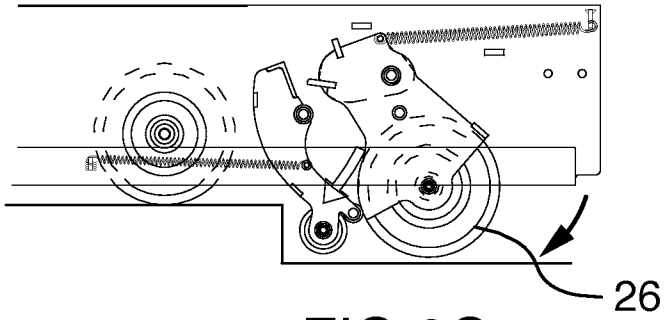
FIG. 9C is a view similar to FIG. 9B with the structure shifted further to the right.

FIG. 9C shows the structure of FIG. 9B shifted yet further to the right; wheel 26 is now engaging the surface 40.

Figure 9D:
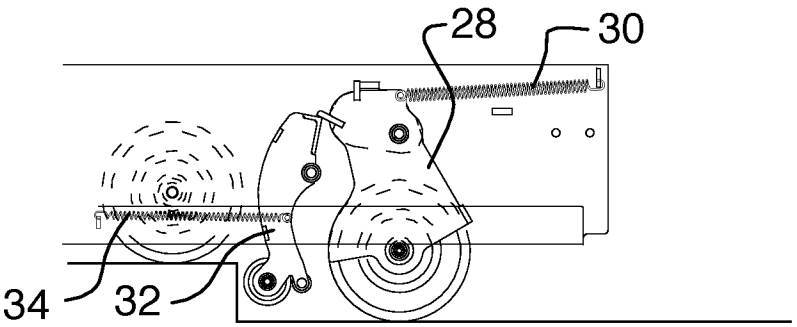
FIG. 9D is a view similar to FIG. 9C with the structure shifted further to the right.
Figures 10, 11, 12, 13:
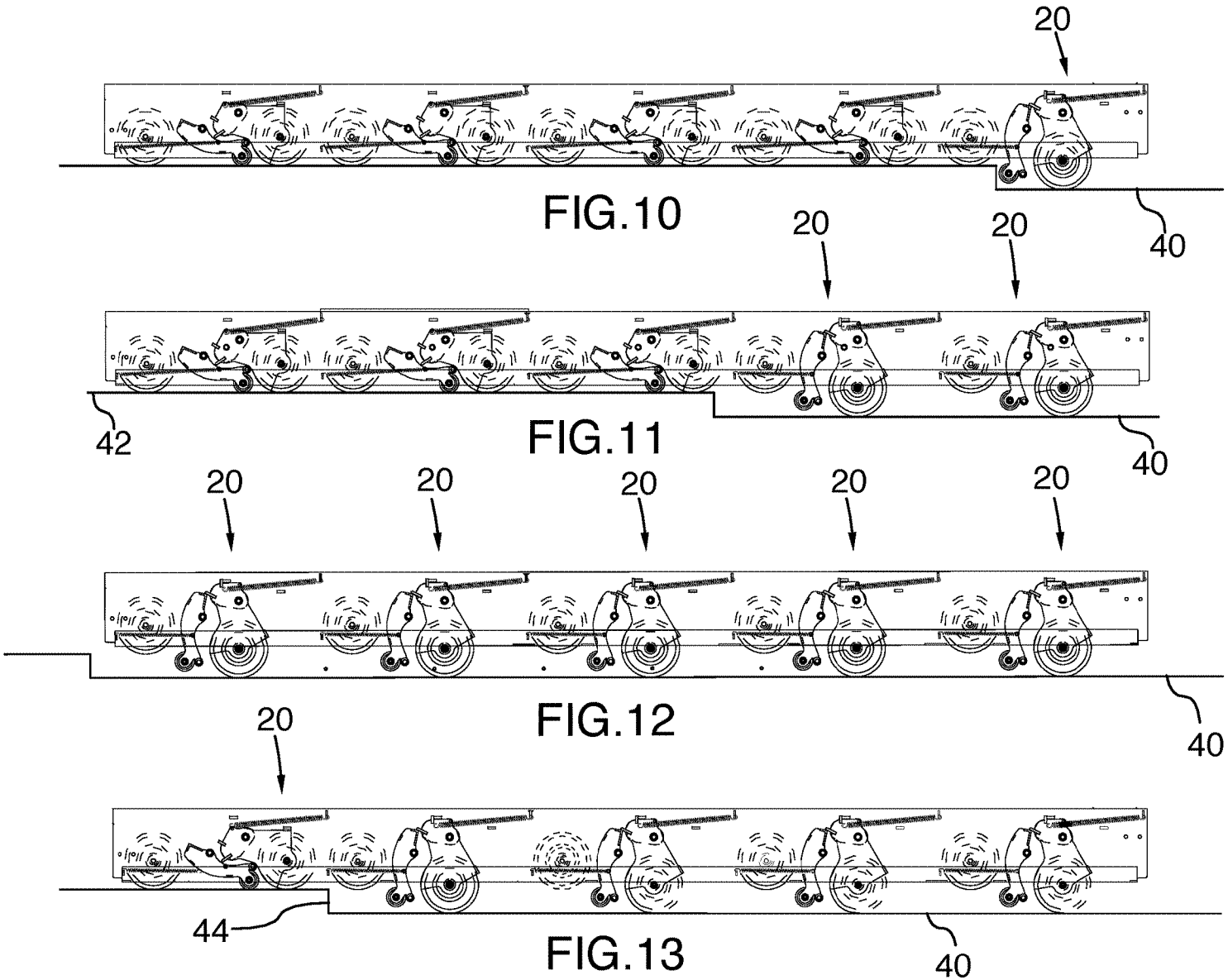
FIG. 10 is a view of the structure of FIG. 8 in the position indicated by FIG. 9D.
FIG. 11 is a view of the structure of FIG. 10 with the structure shifted further to the right.
FIG. 12 is a view of the structure of FIG. 11 with the structure shifted further to the right.
FIG. 13 is a view of the structure of FIG. 12, with the structure shifted slightly to the left.

FIG. 9D shows the structure of FIG. 9C shifted further; strut 28 has now been urged completely to the extended position, and trigger arm 32 has now been urged completely to the locked position, by bias provided by the springs 30,34;

FIG. 10 is a view similar to FIG. 8 showing the entire structure in the position of FIG. 9D.

FIG. 11 is a view similar to FIG. 10, shifted further to the right and now showing the two rightmost apparatus 20 in the fully extended/locked positions on the base surface 40.

FIG. 12 is a view similar to FIG. 11, shifted fully to the right and now showing all of the apparatus 20 on the base surface 40 and in the fully extended/locked positions.

FIG. 13 is a view similar to FIG. 12, shifted to the left such that the leftmost apparatus has now mounted the step 44.

In this regard, it will be evident that the apparatus mounts the step in a manner generally opposite to that shown in FIGS. 9A-9D, to wit:

starting from a position wherein: the apparatus is operatively disposed upon the base surface; the strut is in the extended position; and the trigger arm is in the locked position;

as the apparatus is rolled from the base surface to the raised surface, when the terminal wheel 36 of the trigger arm 32 hits the step 44, the trigger arm 32 pivots away from the locked position, to unlock the strut 28 for movement towards the retracted position;

as the trigger arm 32 bridges the step 44 during movement of the apparatus from the base surface to the raised surface, it urges the strut from the extended position to the retracted position.

Persons of ordinary skill will readily appreciate the utility associated with the foregoing: the components of a retractable bleacher can be readily mounted to the foregoing, to provide a bleacher that can extend up, or down, a step.

The bleacher can merely be extendable and retractable [i.e. an entire bleacher can be mounted for rolling movement on a plurality of the apparatus mounted fixedly to one another] or can be made collapsible, by mounting the apparatus to one another for telescopic movement between a nested configuration, associated with a storage configuration wherein the rows of seats are disposed upon one another and an extended configuration wherein seats are spread apart from one another to define a bleacher. The construction of fixed and extendible bleachers, and the construction of nestable frames, is well known to persons of ordinary skill in the art such that further detail is neither necessary nor provided.

Whereas a specific embodiment is herein shows and described, variations are of course possible. Accordingly, the invention should be understood to be limited only by the accompanying claims, purposively construed.

What is claimed is:

1. Apparatus for use with a facility of the type having: a generally horizontal, planar, base surface; and a generally horizontal, planar raised surface, elevated in relation to the base surface such that a step is formed between the base surface and the raised surface, the apparatus comprising:

a frame; and a plurality of wheel arrangements, each wheel arrangement including:

a strut to which a wheel is rotatably mounted, the strut being pivotable mounted to the frame for movement between:

a retracted position, whereat, when the wheel is operatively positioned upon the raised surface for rolling movement of the apparatus, an uppermost limit of the frame terminates at an elevation;

an extended position, whereat, when the wheel is operatively positioned upon the base surface for rolling movement of the apparatus, the uppermost limit of the frame terminates at the elevation;

a spring biasing the strut for movement towards the extended position;

a trigger arm pivotable between:

a locked position, whereat:

when the strut is in the extended position, the trigger arm locks the strut against movement toward the retracted position; and when the wheel is operatively disposed upon the base surface, the arm projects to an elevation below that of the raised surface; and an unlocked position, whereat:

when the strut is in the retracted position, the trigger arm locks the strut against movement beyond the retracted position and the strut locks the trigger arm against movement beyond the unlocked position; and when the wheel is operatively disposed on the raised surface, the trigger arm projects to the elevation of the raised surface;

a spring biasing the trigger arm for movement towards the locking position;

the wheel arrangement being adapted such that:

when the wheel is operatively disposed upon the base surface, the strut is in the extended position and the trigger arm is in the locked position, as the apparatus is rolled from the base surface to the raised surface, the trigger arm hits the step and pivots away from the locked position to unlock the strut for movement towards the retracted position; and as the trigger arm bridges the step during movement of the apparatus from the base surface to the raised surface, it urges the strut from the extended position to the retracted position; and as the apparatus is driven from the raised surface to the base surface, the springs urge the trigger arm and the strut to the locked and extended positions.

2. Apparatus according to claim 1, wherein the trigger arm has a terminal wheel which, when the trigger arm is in the unlocked position and the wheel is on the raised surface, rolls upon the raised surface.

3. Apparatus according to claim 1, wherein the trigger arm has a roller, which as the strut moves between the extended position and the retracted position, rolls along the strut, to avoid wear.

* * * * *